US008161670B2

(12) United States Patent
Sans Rovira et al.

(10) Patent No.: US 8,161,670 B2
(45) Date of Patent: Apr. 24, 2012

(54) IRONING ROLLER

(75) Inventors: Ramón Sans Rovira, Barcelona (ES); Jordi Mas Gili, Girona (ES)

(73) Assignee: Girbau, S.A., Vic (Barcelona) (ES)

( * ) Notice: Subject to any disclaimer, the term of this patent is extended or adjusted under 35 U.S.C. 154(b) by 492 days.

(21) Appl. No.: 12/304,586

(22) PCT Filed: May 22, 2007

(86) PCT No.: PCT/ES2007/000294

§ 371 (c)(1),
(2), (4) Date: May 7, 2009

(87) PCT Pub. No.: WO2007/147911

PCT Pub. Date: Dec. 27, 2007

(65) Prior Publication Data

US 2009/0277051 A1 Nov. 12, 2009

(30) Foreign Application Priority Data

Jun. 16, 2006 (ES) ..... 200601625

(51) Int. Cl.
*D06F 67/02* (2006.01)
*D06F 65/02* (2006.01)

(52) U.S. Cl. ..... 38/44

(58) Field of Classification Search ..... 38/44–59, 38/14; 100/337–340
See application file for complete search history.

(56) References Cited

U.S. PATENT DOCUMENTS

| | | | | | |
|---|---|---|---|---|---|
| 2,678,600 | A | * | 5/1954 | Allen, Jr. | 100/340 |
| 3,903,961 | A | | 9/1975 | Stanislaw | |
| 4,418,486 | A | | 12/1983 | Kober | |
| 4,677,773 | A | | 7/1987 | Kamberg | |
| 4,781,795 | A | * | 11/1988 | Miller | 162/358.5 |
| 5,022,169 | A | * | 6/1991 | Jensen | 38/56 |
| 5,590,704 | A | | 1/1997 | Eriksen et al. | |
| 6,000,156 | A | * | 12/1999 | Chern et al. | 38/44 |
| 6,341,436 | B2 | | 1/2002 | Grandpierre et al. | |
| 2001/0015025 | A1 | * | 8/2001 | Grandpierre et al. | 38/44 |

FOREIGN PATENT DOCUMENTS

| | | | |
|---|---|---|---|
| EP | 0 599 756 | A1 | 6/1994 |
| EP | 1 130 152 | A1 | 9/2001 |
| GB | 2 102 842 | A | 2/1983 |

OTHER PUBLICATIONS

International Search Report for PCT International Application No. PCT/ES2007/000294 mailed Sep. 9, 2007.

* cited by examiner

*Primary Examiner* — Ismael Izaguirre
(74) *Attorney, Agent, or Firm* — RatnerPrestia

(57) ABSTRACT

An ironing roller includes a first annular chamber in communication with an inlet and an outlet arranged to rotate about a longitudinal axis, where the first annular chamber forms a passage through which a heat carrying fluid heated by heating device located inside the ironing roller circulates, a circuit external to the annular chamber being arranged to lead the heat carrying fluid from the outlet to the inlet of the chamber. A second annular chamber adjacent and coaxial to the first annular chamber is provided, the two annular chambers being intercommunicated for the circulation of the heat carrying fluid from one of the annular chambers to the other, and where one of the annular chambers carries out a heat uptake function and the other one carries out a heat transfer function.

12 Claims, 2 Drawing Sheets

IRONING ROLLER

This application is a U.S. National Phase Application of PCT International Application No. PCT/ES2007/000294, filed May 22, 2007.

TECHNICAL FIELD

The present invention generally relates to an ironing roller with a heating device which is applicable in the field of laundry machinery as an ironing roller in an ironing-drying machine, and more particularly to an ironing roller provided with coaxial annular chambers for the circulation of a heat carrying fluid and heating means for heating said fluid inside one of said chambers.

BACKGROUND OF THE INVENTION

The use of a roller provided with an inner annular chamber which is at least partly filled with a hot heat carrying fluid or through which a hot heat carrying fluid can circulate to heat an external cylindrical wall of the roller, which roller provides a suitable ironing surface to make contact with the articles to be ironed, is known in the art in the field of laundry machinery. The problem to be solved is how to distribute the hot heat carrying fluid inside the chamber along the roller to ensure a uniform heating of the external cylindrical wall all along the roller.

U.S. Pat. No. 4,418,486, belonging to the public domain, discloses an ironing roller with a heating device comprising two concentric cylindrical walls arranged to rotate together about a common longitudinal axis. The external cylindrical wall provides a suitable ironing surface to make contact with the articles to be ironed, and an annular chamber in communication with an inlet at a first end of the roller and with an outlet at a second end of the roller is formed between the external cylindrical wall and the inner cylindrical wall, such that the chamber forms a passage through which a heat carrying fluid heated by an external heating device can pass. Helical fins or blades are arranged in the chamber with a single rotation direction to propel the heat carrying fluid inside the chamber from said inlet to said outlet as a result of the rotation of the roller. An external circuit, to which an impulse pump is coupled, is arranged to propel the return heat carrying fluid from the outlet to the inlet of the chamber.

The mentioned U.S. Pat. No. 4,418,486 teaches how to circulate the heat carrying fluid inside the chamber from the inlet to the outlet and how to return the heat carrying fluid from the outlet to the inlet passing through heating means and an external pump. A drawback of this construction is the need to have considerable equipment outside the roller, formed by a circuit, heating means, an expansion tank, one or more pumps, etc., as well as rotary joints to connect the conduits of the external circuit to the inlet and outlet of the chamber, which joints are arranged axially through pivot joints at each end of the roller.

U.S. Pat. No. 4,677,773 describes a rotary flatwork ironer comprising a roller formed with a double wall providing a closed annular chamber for a fluid, means for rotatably supporting the roller with respect to a horizontal axis, a fluid inlet and a fluid outlet at opposite ends of the chamber, heating means arranged in a stationary manner inside the roller to heat the fluid inside the chamber, a flow circulation system to make the fluid circulate from said outlet to said inlet passing through a rotating joint and an external circuit including a pump, a cooling tank and an expansion tank, and temperature control means arranged in a part of the circulation system outside the roller and adapted to detect the temperature of the fluid and to start and stop the heating means in response to the detected fluid temperature.

Patent EP-A-1130152 discloses a drying ironing machine provided with an ironing roller with a heating device using a heat carrying fluid. The ironing roller is provided with a cylindrical wall and is suitable to rotate about an axis of said cylindrical wall. Inside the roller there are arranged conventional heating means such as those described in the mentioned U.S. Pat. No. 4,677,773 to heat the cylindrical wall. The roller further comprises an external wall surrounding the cylindrical wall in order to delimit with the latter a closed annular chamber, which is partially filled with a heat carrying fluid. The roller further comprises stirring means for stirring the fluid including members placed in said annular chamber and suitable for generating circulation of the heat carrying fluid inside the chamber according to the teachings disclosed by the aforementioned U.S. Pat. No. 4,418,486. The mentioned external wall provides an ironing surface. According to a first embodiment (FIG. 3 of the mentioned patent), said members are passive members in the form of helical blades borne by the cylindrical wall and arranged inclined with respect to the axis of the roller to generate circulation of the heat carrying fluid when the roller rotates about its axis. In two opposite halves of the roller, the helical blades have opposite rotation directions to propel the heat carrying fluid in opposite directions. According to a second embodiment, (FIG. 5 of the mentioned patent), the members are partitions arranged in a stepped manner in the annular chamber in order to delimit, between the cylindrical wall and the external wall, a zigzag back and forth path which is considerably parallel to the axis of the roller, and the stirring means further comprise a pump on the roller to make the heat carrying fluid circulate according to said path The heating means of the roller described in the mentioned patent EP-A-1130152 dispense with any external equipment. However, a drawback of the first embodiment is that the mentioned helical blades do not ensure uniform distribution of the heat carrying fluid along the roller due to the fact the return circulation is carried out, after the collision of opposite fluid streams, mixed with the propelling circulation of the blades. If the blades propel the fluid in opposite directions towards the center of the roller during rotation, the fluid tends to accumulate in the central area of the roller. If on the other hand, the blades propel the fluid in opposite directions towards the ends of the roller, the fluid will tend to accumulate in the areas close to the ends of the roller. A drawback of the second embodiment is the need to incorporate an impulse pump on the roller, the proposed winding configuration of the fluid distribution circuit, which can be expensive to carry out, and the need of rotary electrical connections for the connecting cables for connecting the pump to an external power supply source.

DISCLOSURE OF THE INVENTION

The present invention provides a new ironing roller in which, in a preferred embodiment, means for propelling fluid inside an annular chamber as described in patent U.S. Pat. No. 4,418,486 are used, but providing a second annular chamber, internally or externally coaxial with the first chamber, such that the circulation of the heat carrying fluid takes place by continuously passing from one of said two chambers to the other, which chambers fulfill a heat uptake function (that chamber facing the heat source) and a heat transfer function (that chamber adjacent to the surface of the roller), respectively.

To that end, an ironing roller is proposed, comprising a first cylindrical wall and a second cylindrical wall having a different diameter, which are concentric and arranged to rotate together about a common longitudinal axis, a first annular chamber being delimited between said first and second cylindrical walls in communication with one or more inlets defined at a first end and at least one outlet at a second end, such that said annular chamber forms a passage through which a heat carrying fluid circulates, said heat carrying fluid being heated by heating means located inside the ironing roller, and a return circuit being provided external to said first chamber to lead the heat carrying fluid from the outlet to the inlet of the annular chamber. According to the invention, a second annular chamber which is adjacent and coaxial with the first annular chamber is provided, this second annular chamber being arranged on either side of the first annular chamber, i.e. the larger diameter of the first chamber can be equal to or less than the smaller diameter of the second chamber, thereby the second chamber would be in a part of the roller that is more external than the first chamber, or the smaller diameter of the first chamber can be equal to or greater than the larger diameter of the second chamber, thereby the second chamber would be in a part of the roller that is more internal than the first chamber. These two annular chambers are intercommunicated such that the heat carrying fluid can continuously circulate from one of the annular chambers to the other, said return circuit external to the first annular chamber being carried out through the second annular chamber. One of the mentioned first or second annular chambers carries out a heat uptake function and the other of the mentioned first or second annular chambers carries out a heat transfer function, transferring heat to the external wall of the roller.

According to the principles of the invention, two or more intercommunicated annular chambers in the mentioned arrangement can be used, providing fluid circulation therethrough which will be carried out by means of helical fin or blade propelling means, active when the roller rotates, or by pump means such as those described in the mentioned background documents.

The communication way between the chambers can be diverse, and it is generally carried out between the end areas of each chamber and through the inside of the roller, or externally to it next to the respective ends of the roller.

In a particular embodiment, it has been foreseen that the second annular chamber adopts the form of a coil located inside the first annular chamber and arranged to rotate together with the first and second cylindrical walls about said longitudinal axis, in which case the second annular chamber in the form of a coil carries out said heat uptake function and the first annular chamber carries out said heat transfer function. The ends of the coil are connected to the ends of the first annular chamber which is delimited by the ironing cylinder. Two or more suitably displaced or offset coils can optionally be provided.

BRIEF DESCRIPTION OF THE DRAWINGS

The previous and other features and advantages will be more fully understood from the following detailed description of several embodiments with reference to the attached drawings, in which.

DETAILED DESCRIPTION OF AN EXEMPLARY EMBODIMENT

The same alphanumeric references have been used to designate identical or equivalent elements in the different embodiments described below.

Figure 1:
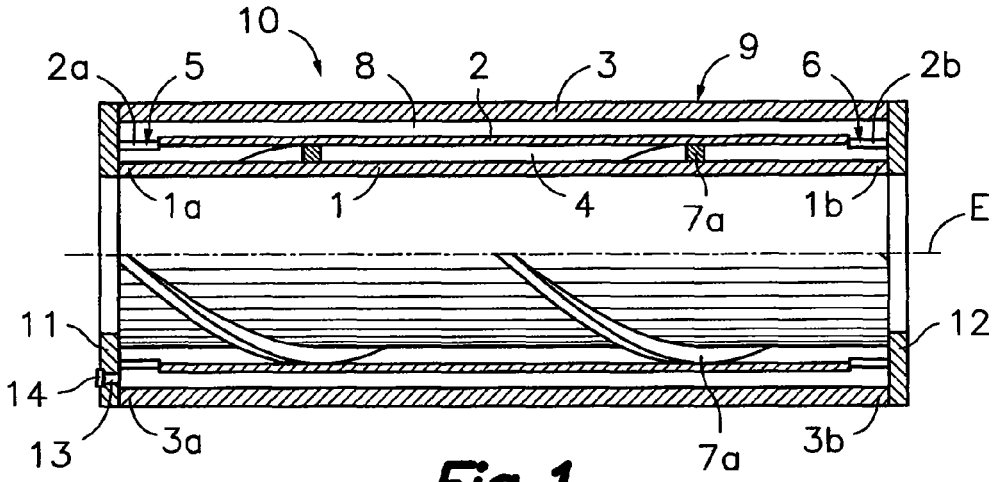
FIG. 1 shows a partially sectioned side view of a first embodiment of the ironing roller of the present invention.

With reference first to FIG. 1, reference numeral 10 designates an ironing roller constructed according to a first embodiment of the present invention, which comprises a first inner cylindrical wall 1, a second intermediate cylindrical wall 2 and a third external cylindrical wall 3, mutually concentric and arranged to rotate together about a common longitudinal axis E. A first annular chamber 4 is formed between the mentioned first and second cylindrical walls 1, 2 and a second annular chamber 8 is formed between the mentioned second and third cylindrical walls 2, 3. The second annular chamber 8 envelops the first annular chamber 4, although, as will be seen below, in some alternative embodiments the second annular chamber 8 can be enveloped by the first annular chamber 4. The first annular chamber 4 has an inlet 5 at a first end in communication with a first end of the second chamber 8, and an outlet 6 at a second end in communication with a second end of the second chamber 8. The first and second annular chambers 4, 8 are leak-proof and are completely or partially filled with a heat carrying fluid (not shown). The first annular chamber 4 thus forms a passage through which a heat carrying fluid circulates from the inlet 5 to the outlet 6 and the second annular chamber 8 forms a return circuit for leading the heat carrying fluid from the outlet 6 to the inlet 5. A partial filling of the first and second annular chambers 4, 8 allows accommodating the possible expansions and contractions of the fluid without additional equipment. If a complete filling of the first and second annular chambers 4, 8 is preferred, it is recommendable to arrange a bypass duct towards an expansion tank, which can be on the roller or in an external static location, in which case it is necessary to pass a connection or bypass duct through a rotary joint.

Conventional heating means (not shown) are arranged inside the ironing roller 10, which means are adapted to heat the first cylindrical wall 1, and the heat carrying fluid which is located in the first annular chamber 4 is heated by direct contact with the first cylindrical wall 1. Blades 7*a* are arranged in the first annular chamber 4, which blades are inclined with respect to the mentioned longitudinal axis E of the ironing roller 10 to propel the heat carrying fluid inside the first annular chamber 4 from said inlet 5 to said outlet 6. The flow of heat carrying fluid leaving the first annular chamber 4 through the outlet 6 enters the second annular chamber 8 and circulates in an opposite direction therealong up to the opposite end, where it again enters the first annular chamber 4 through the inlet 5. The third cylindrical wall 3 is heated by direct contact with the heat carrying fluid circulating through the second annular chamber 8 from the outlet 6 to the inlet 5, and the third cylindrical wall 3 has an external ironing surface 9 adapted to make contact with the articles to be ironed. The first annular chamber 4 thus carries out a heat uptake function for uptaking the heat coming from the heating means located inside the roller and the second annular chamber 8 carries out a heat transfer function for transferring heat to the articles to be ironed. The rotation of the ironing roller 10 and the continuous circulation of the heat carrying fluid along the first and second annular chambers 4, 8 ensure uniform distribution of heat through the entire third cylindrical wall 3.

The first embodiment of FIG. 1 is constructed as follows. The first and third cylindrical walls 1, 3 have first ends 1*a*, 3*a* hermetically joined to a first side wall 11 and second ends 1*b*, 3*b* hermetically joined to a second side wall 12. The second intermediate cylindrical wall 2 has first and second ends 2*a*, 2*b* respectively joined to said first and second side walls 11, 12 and a series of openings adjacent to said first and second ends 2*a*, 2*b* forming the inlet 5 and the outlet 6 of the first annular chamber 4 in communication with the second annular chamber 8. The mentioned blades 7*a* comprise two continuous offset helical blades having one and the same rotation direction fixed to the first cylindrical wall 1 and to the second cylindrical wall 2. For the sake of greater clarity in the drawing, the first cylindrical wall 1 and the blades 7*a* are shown without sectioning in the lower half of FIG. 1, below the mentioned longitudinal axis E. To fill and empty the first and second annular chambers 4, 8, one of said first and second side walls 11, 12 of the ironing roller 10 comprises a filling and emptying mouth 13 which can be blocked by a plug 14.

Alternative constructions for the ironing roller 10 will occur to a person skilled in the art without departing from the scope of the present invention. For example, the blades 7*a* can alternatively comprise only one or more than two helical blades, or a plurality of short inclined blades distributed inside the first cylindrical chamber 4, or the helical blades can be continuous or interrupted. Alternatively, the first and second ends 2*a*, 2*b* of the second intermediate cylindrical wall 2 can be respectively separate from said first and second side walls 11, 12 in order to provide the inlet 5 and the outlet 6, in which case the blades 7*a* would be fixed to the first cylindrical wall 1 and the second cylindrical wall 2 would be held in place by the blades 7*a*.

Figure 2:
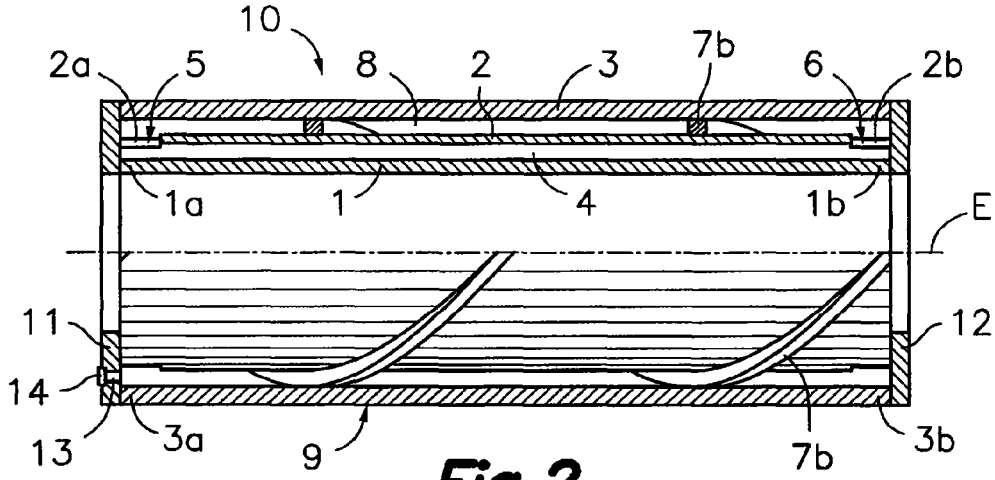
FIG. 2 shows a partially sectioned side view of a second embodiment of the ironing roller of the present invention.
Figure 3:
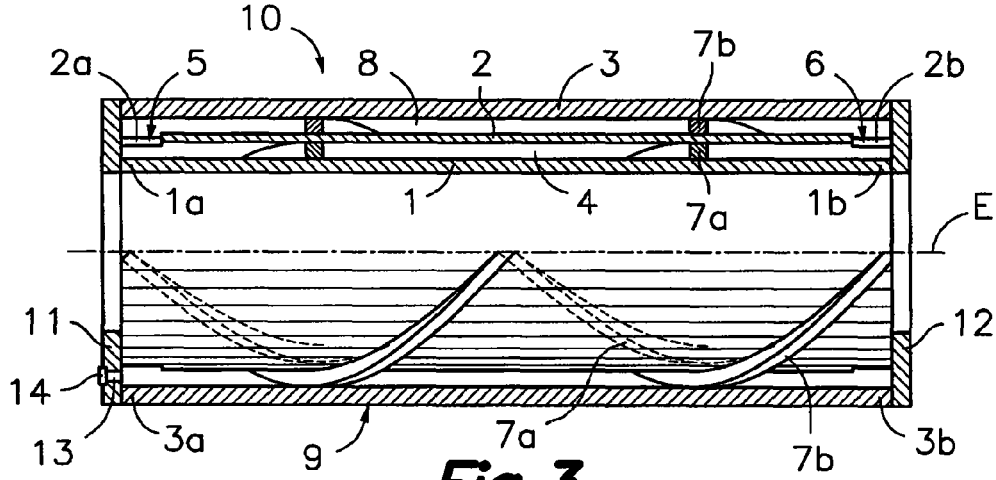
FIG. 3 shows a partially sectioned side view of a third embodiment of the ironing roller of the present invention.

Second and third embodiments for the ironing roller 10 of the present invention are shown in FIGS. 2 and 3, which have a construction similar to that described above in relation to the first embodiment, except for the arrangement of the blades. Therefore, the detailed description of the construction of the ironing rollers 10 according to these second and third embodiments will be omitted except as regards the arrangement of the blades.

In the second embodiment shown in FIG. 2, the ironing roller 10 comprises blades 7*b* arranged inside the second annular chamber 8, which is an external annular chamber carrying out the heat transfer function. Here, the blades 7*b* can include one or more continuous helical blades with one and the same rotation direction which is suitable for propelling the fluid inside the second annular chamber 8 from the outlet 6 to the inlet 5 of the first annular chamber 4, which carries out the heat uptake function. For the sake of greater clarity in the drawing, the second cylindrical wall 2 and the blades 7*b* are shown without sectioning in the lower half of FIG. 2, below the mentioned longitudinal axis E.

In the third embodiment shown in FIG. 3, the ironing roller 10 comprises first blades 7*a* arranged inside the first annular chamber 4, which is an inner chamber carrying out the heat uptake function, and second blades 7*b* arranged inside the second annular chamber 8, which is an external annular chamber carrying out the heat transfer function. Here, the first blades 7*a* can include one or more continuous helical blades with one and the same rotation direction suitable for propelling the fluid inside the first annular chamber 4 from the inlet 5 to the outlet 6 and the second blades 7*b* can include one or more continuous helical blades with one and the same rotation direction, opposite to the rotation direction of the first blades 7*a*, suitable for propelling the fluid inside the second annular chamber 8 from the outlet 6 to the inlet 5 of the first annular chamber 4. For the sake of greater clarity in the drawing, the second cylindrical wall 2 is shown without sectioning and the first blades 7*a* are shown in dotted lines in the lower half of FIG. 3, below the mentioned longitudinal axis E.

Figure 4:
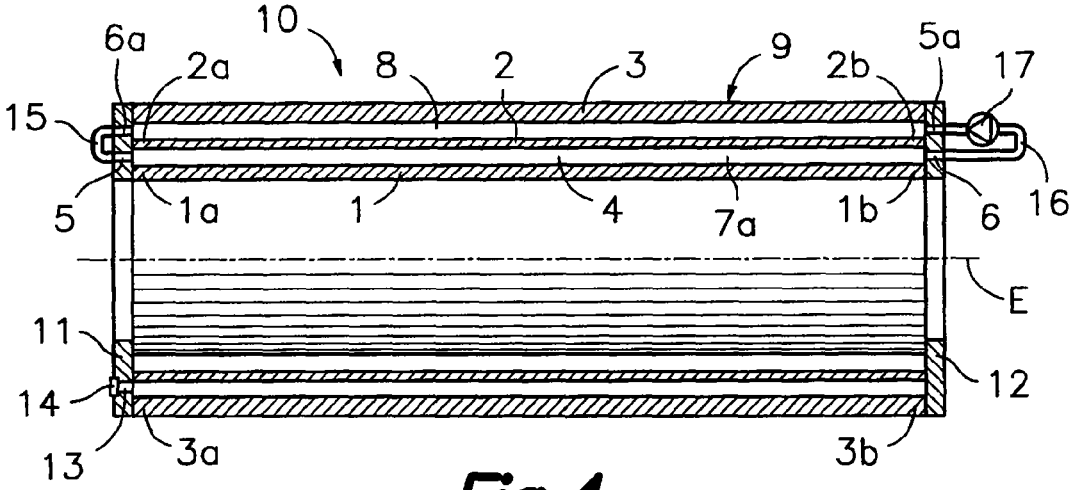
FIG. 4 shows a partially sectioned side view of a fourth embodiment of the ironing roller of the present invention.

In relation to FIG. 4, a fourth embodiment of the ironing roller 10 of the present invention is hereafter described, which comprises mutually concentric first, second and third cylindrical walls 1, 2, 3 arranged to rotate together about a common longitudinal axis E, forming a first inner annular chamber 4 between the mentioned first and second cylindrical walls 1, 2 and a second external annular chamber 8 between the second and third cylindrical walls 2, 3. First and second side walls 11, 12 close the ends of the first and second annular chambers 4, 8, and the first chamber 4 has an inlet 5 through the first side wall 11 and an outlet 6 through the second side wall 12. The second chamber 8 also has an outlet 6*a* through the first side wall 11 and an inlet 5*a* through the second side wall 12. The inlet 5 of the first annular chamber 4 is connected to the outlet 6*a* of the second annular chamber 8 by a first conduit 15 and the outlet 6 of the first annular chamber 4 is connected to the inlet 5*a* of the second annular chamber 8 by a second conduit 16. For the sake of greater clarity in the drawing, the first cylindrical wall 1 is shown without sectioning in the lower half of FIG. 1, below the mentioned longitudinal axis E.

A heat carrying fluid completely or partially fills the first and second annular chambers 4, 8, and a pump 17 is connected to the second conduit 16 to propel the heat carrying fluid from the inlet 5 to the outlet 6 through the first chamber 4 and from the inlet 5*a* to the outlet 6*a* through the second chamber 8. The first and second conduits 15, 16 and said pump 17 are arranged to rotate together with the first, second and third cylindrical walls 1, 2, 3 about the longitudinal axis E. Heating means (not shown) are arranged inside the ironing roller 10 to heat the first cylindrical wall 1 and indirectly the heat carrying fluid inside the first cylindrical chamber 4. The third cylindrical wall 3 is heated by direct contact with heat carrying fluid circulating through the second annular chamber 8, and the third cylindrical wall 3 has an external ironing surface 9 adapted to make contact with the articles to be ironed. The first annular chamber 4 thus carries out the heat uptake function and the second annular chamber 8 carries out the heat transfer function.

The pump 17 could alternatively be connected to the first conduit 15 instead of the second conduit 16 with an equivalent result. With the construction shown in FIG. 4, the heat carrying fluid only partially fills the first and second annular chambers 4, 8 and the pump 17 works under vacuum during the part of the rotation cycle of the ironing roller 10 in which the pump is located in the upper area. According to another alternative construction (not shown), the heat carrying fluid completely fills the first and second annular chambers 4, 8, therefore the pump 17 works by propelling the heat carrying fluid during the entire rotation cycle of the ironing roller 10, and the system includes an expansion tank connected to the first and second annular chambers 4, 8 through a duct. The mentioned expansion tank can be installed on the ironing roller 10 to rotate therewith, or be externally arranged in a stationary location and connected by a duct through a rotary joint located coaxially to the longitudinal axis E.

Figure 5:
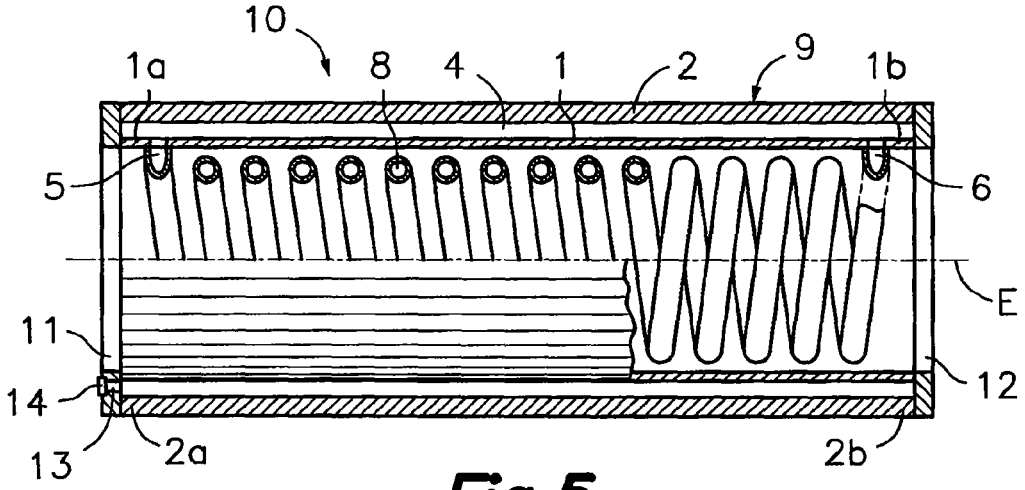
FIG. 5 shows a partially sectioned side view of a fifth embodiment of the ironing roller of the present invention.

FIG. 5 shows a fifth embodiment of the ironing roller 10 of the present invention, comprising first and second concentric cylindrical walls 1, 2 between which there is formed a first annular chamber 4 closed at its ends by first and second side walls 11, 12. A second annular chamber 8 in the form of a coil is arranged inside the first annular chamber 4 to rotate together with the first and second cylindrical walls 1, 2 about a longitudinal axis E. The mentioned coil forming the second annular chamber 8 has the shape of a helical tube with ends connected to the inlet 5 and to the outlet 6 of the first chamber, respectively. For the sake of greater clarity in the drawing, the first cylindrical wall 1 is shown without sectioning in the left-hand area of the lower half of FIG. 1, below the mentioned longitudinal axis E, and a portion of the coil forming the second annular chamber 8 is shown without sectioning in the right-hand area of FIG. 5.

Heating means (not shown) are arranged inside the ironing roller 10 of FIG. 5 to heat the second annular chamber 8 in the form of a coil, and to indirectly heat, through the wall of the tube of the coil, the heat carrying fluid which is located inside the second annular chamber 8. The second cylindrical wall 2 is heated by the heat carrying fluid circulating through the first annular chamber 4 and provides an external ironing surface 9 suitable for making contact with the articles to be ironed. The second annular chamber 8 in the form of a coil thus carries out the heat uptake function and the first annular chamber 4 carries out the heat transfer function. The second annular chamber 8 in the form of a coil furthermore carries out the function of propelling the heat carrying fluid inside the first annular chamber 4 from said inlet 5 to said outlet 6 and inside the second annular chamber 8 from the outlet 6 to the inlet 5 due to the effect of the rotation of the ironing roller 10. When a number of inlets 5 and a number of outlets 6 are wanted to be arranged distributed around the first annular chamber 4, an identical number of suitably offset second annular chambers 8 in the form of a coil can be arranged, each of such chambers connecting one outlet 6 to one inlet 5.

In all the embodiments, inlet 5 generally includes one or more openings located in, or adjacent to, a first end of the first annular chamber 4 and in communication with an outlet of the second annular chamber 8 including one or more openings arranged in, or adjacent to, a first end thereof, and said outlet 6 includes one or more openings located in, or adjacent to, a second end of the first annular chamber 4 and in communication with an inlet of the second annular chamber 8 including one or more openings arranged in, or adjacent to, a second end thereof, the first ends of the first and second annular chambers 4, 8 being contiguous and opposite to the respective second ends. This constriction ensures that the heated heat carrying fluid reaches both ends of the annular chambers carrying out the heat uptake and heat transfer functions.

Figure 6:
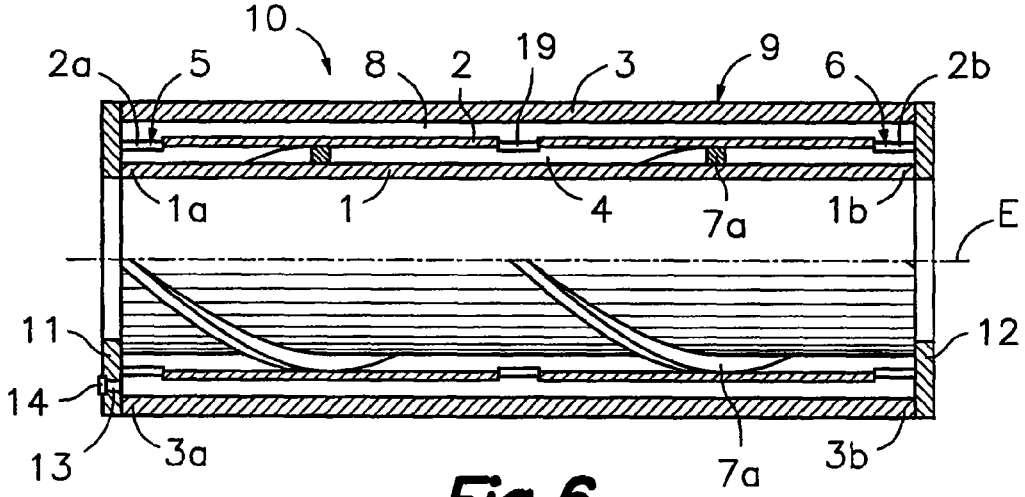
FIG. 6 shows a partially sectioned side view of an ironing roller according to a variant of the first embodiment.

FIG. 6 shows a variant of the first embodiment in which, in addition to the inlet 5 and the outlet 6 located at the first and second ends of the first annular chamber 4, the ironing roller 10 includes one or more communications 19 between the first and second annular chambers 4, 8, formed by openings formed in the second cylindrical wall 2 and located in an area between the mentioned respective first and second ends. The circulation of the heat carrying fluid between the first and second annular chambers 4, 8 is thus increased. Helical blades or fins with a single rotation direction are arranged in the first annular chamber 4 to propel the heat carrying fluid inside the chamber as explained.

A person skilled in the art will be able to introduce modifications and changes in the embodiments shown and described above without departing from the scope of the present invention as defined in the attached claims.

The invention claimed is:

1. An ironing roller comprising:

a heater disposed therein, at least one first cylindrical wall and one second cylindrical wall, which are concentric and arranged to rotate together about a common longitudinal axis, a first annular chamber being formed between said first and second cylindrical walls in communication with at least one inlet and at least one outlet, said first annular chamber forming a passage through which a heat carrying fluid heated by the heater circulates, and at least one second annular chamber adjacent and coaxial to said first annular chamber, said first and second annular chambers being intercommunicated such that the heat carrying fluid can be circulated from one to the other, said second annular chamber forming a circuit external to said first annual chamber through which the heat carrying fluid is lead from the outlet to the inlet of the first annular chamber, wherein one of said first and second annular chambers performs a heat uptake function for uptaking heat from the heater located inside the roller and the other of said first and second annular chambers performs a heat transfer function for transferring heat to articles to be ironed.

2. An ironing roller having a heater disposed therein, the ironing roller comprising:

at least one first cylindrical wall and one second cylindrical wall, which are concentric and arranged to rotate together about a common longitudinal axis, a first annular chamber being formed between said first and second cylindrical walls and in communication with at least one inlet and at least one outlet, where said first annular chamber forms a passage through which a heat carrying fluid heated by the heater circulates, a circuit external to said first annular chamber being arranged to lead the heat carrying fluid from the outlet to the inlet of the first annular chamber, and at least one second annular chamber adjacent and coaxial to said first annular chamber, said first and second annular chambers being intercommunicated such that the heat carrying fluid can be circulated from one to the other, said circuit external to said first annual chamber being carried out through the second chamber and where one of said first and second annular chambers performs a heat uptake function and the other of said first and second annular chambers performs a heat transfer function, wherein the ironing roller comprises a third concentric external cylindrical wall with a larger diameter than a diameter of the second cylindrical wall, said third cylindrical wall being arranged to rotate together with the first and second cylindrical walls about said longitudinal axis, the second annular chamber in communication with the inlet and the outlet of the first chamber being formed between said second and third cylindrical walls, said second annular chamber forming the circuit external to the first chamber for the heat carrying fluid, where the first annular chamber carries out said heat uptake function and the second annular chamber carries out said heat transfer function.

3. A roller according to claim 2, wherein the third cylindrical wall is heated by contact with the heat carrying fluid circulating through the second annular chamber from the outlet to the inlet and provides an external ironing surface suitable for making contact with articles to be ironed.

4. An ironing roller according to claim 3, wherein in at least one of the first annular chamber and/or in the second annular chamber blades inclined with respect to said longitudinal axis are arranged to propel the heat carrying fluid inside the first annular chamber from said inlet to said outlet and inside the second annular chamber from the outlet to the inlet due to the effect of the rotation of the ironing roller.

5. A roller according to claim 4, wherein said blades are arranged inside the first annular chamber.

6. A roller according to claim 4, wherein said blades are arranged inside the second annular chamber.

7. A roller according to claim 4, wherein several first blades of said blades are arranged inside the first annular chamber and several second blades of said blades are arranged inside the second annular chamber, the first and second blades having opposite inclinations with respect to the longitudinal axis.

8. A roller according to claim 3, wherein the inlet of the first annular chamber is connected to one end of the second annular chamber by a first conduit and the outlet of the first annular chamber is connected to another end of the second annular chamber by a second conduit, a pump being connected to one of said first or second conduits to propel the fluid through the first and second chambers, the first and second conduits and said pump being arranged to rotate together with the first, second and third cylindrical walls about the longitudinal axis.

9. An ironing roller having a heater disposed therein, the ironing roller comprising:

at least one first cylindrical wall and one second cylindrical wall, which are concentric and arranged to rotate together about a common longitudinal axis, a first annular chamber being formed between said first and second cylindrical walls and in communication with at least one inlet and at least one outlet, where said first annular chamber forming a passage through which a heat carrying fluid heated by the heater circulates, a circuit external to said first annular chamber being arranged to lead the heat carrying fluid from the outlet to the inlet of the first annular chamber, and at least one second annular chamber adjacent and coaxial to said first annular chamber, said first and second annular chambers being intercommunicated such that the heat carrying fluid can be circulated from one to the other, said circuit external to said first annual chamber being carried out through the second chamber and where one of said first and second annular chambers performs a heat uptake function and the other of said first and second annular chambers performs a heat transfer function, wherein the second annular chamber adopts the form of at least one coil located inside the first annular chamber and arranged to rotate together with the first and second cylindrical walls about said longitudinal axis, where the second annular chamber in the form of a coil carries out said heat uptake function and the first annular chamber carries out said heat transfer function, and where the second annular chamber in the form of a coil further carries out the function of propelling the heat carrying fluid inside the first annular chamber from said inlet to said outlet and inside the second annular chamber from the outlet to the inlet due to the effect of the rotation of the ironing roller.

10. A roller according to claim 9, wherein the mentioned coil forming the second annular chamber has the shape of a helical tube with ends connected to the inlet and to the outlet of the first chamber, respectively, where the second cylindrical wall provides an external ironing surface suitable for making contact with the articles to be ironed.

11. A roller according to claim 1, wherein said at least one inlet is located in or adjacent to a first end of the first annular chamber and in communication with an outlet arranged in or adjacent to a first end of the second annular chambers, and said at least one outlet is located in or adjacent to a second end of the first annular chamber opposite to the first end thereof and in communication with an inlet arranged in or adjacent to a second end of the second annular chamber opposite to the first end thereof.

12. A roller according to claim 1, further comprising at least one communication between the first and second annular chambers located in an area between the respective first and second ends.

* * * * *